US009689325B2

(12) United States Patent
Nanba

(10) Patent No.: US 9,689,325 B2
(45) Date of Patent: Jun. 27, 2017

(54) EVAPORATIVE FUEL PROCESSING SYSTEM

(71) Applicant: DENSO CORPORATION, Kariya, Aichi-pref. (JP)

(72) Inventor: Kunio Nanba, Anjo (JP)

(73) Assignee: DENSO CORPORATION, Kariya (JP)

( * ) Notice: Subject to any disclaimer, the term of this patent is extended or adjusted under 35 U.S.C. 154(b) by 304 days.

(21) Appl. No.: 14/672,890

(22) Filed: Mar. 30, 2015

(65) Prior Publication Data

US 2015/0285170 A1 Oct. 8, 2015

(30) Foreign Application Priority Data

Apr. 7, 2014 (JP) ..... 2014-78646

(51) Int. Cl.
*F02B 41/00* (2006.01)
*F02D 41/00* (2006.01)

(52) U.S. Cl.
CPC ..... *F02D 41/004* (2013.01); *F02D 2200/021* (2013.01); *F02D 2200/0406* (2013.01)

(58) Field of Classification Search
CPC ..... F02D 41/004; F02D 2200/0406; F02D 2200/021
See application file for complete search history.

(56) References Cited

U.S. PATENT DOCUMENTS 5,054,454 A * 10/1991 Hamburg ..... F02D 41/004 123/520
5,080,078 A * 1/1992 Hamburg ..... F02M 25/08 123/519
5,273,020 A * 12/1993 Hayami ..... F02M 25/08 123/516
5,445,132 A * 8/1995 Isobe ..... F02D 41/004 123/198 D
6,105,557 A * 8/2000 Schnaibel ..... F02M 25/0818 123/198 D
6,138,644 A * 10/2000 Saruwatari ..... F02M 25/08 123/519
6,182,642 B1 * 2/2001 Ohkuma ..... F02M 25/0818 123/519
6,196,202 B1 * 3/2001 Busato ..... F02M 25/089 123/198 D
7,216,637 B2 * 5/2007 Uchida ..... F02M 25/089 123/198 D (Continued)

*Primary Examiner* — Hieu T Vo
*Assistant Examiner* — Sherman Manley
(74) *Attorney, Agent, or Firm* — Nixon & Vanderhye P.C.

(57) ABSTRACT

A purge pump is installed in a purge conduit, which forms a purge passage that communicates between an inside of a canister and an air intake passage. When a pressure of the air intake passage is equal to or smaller than a predetermined pressure, a large quantity of evaporative fuel, which is larger than a predetermined purge quantity, is introduced into the air intake passage. At this time, a pump electric power supply device supplies a relatively small amount of the electric power to the purge pump to run the purge pump. When the pressure of the air intake passage is larger than the predetermined pressure, the purge pump is driven to pump the evaporative fuel into the air intake passage. At that time, the pump electric power supply device supplies a relatively large amount of the electric power to the purge pump.

4 Claims, 4 Drawing Sheets

(56) References Cited

U.S. PATENT DOCUMENTS

| | | | | |
|---|---|---|---|---|
| 7,966,996 | B1 * | 6/2011 | Pursifull | F02B 37/127 123/198 C |
| 9,518,538 | B2 * | 12/2016 | Pearce | F02M 25/0818 |
| 2006/0144373 | A1 * | 7/2006 | Kano | F02D 41/0045 123/519 |
| 2007/0227515 | A1 * | 10/2007 | Uchida | F02M 25/089 123/520 |
| 2011/0253110 | A1 * | 10/2011 | Fukui | F02D 41/004 123/520 |
| 2015/0345411 | A1 * | 12/2015 | Ooiwa | F02D 41/004 123/520 |
| 2016/0123280 | A1 * | 5/2016 | Makino | F02M 25/089 123/519 |
| 2016/0298578 | A1 * | 10/2016 | Makino | F02M 35/10222 |

* cited by examiner

EVAPORATIVE FUEL PROCESSING SYSTEM

CROSS REFERENCE TO RELATED APPLICATION

This application is based on and incorporates herein by reference Japanese Patent Application No. 2014-78646 filed on Apr. 7, 2014.

TECHNICAL FIELD

The present disclosure relates to an evaporative fuel processing system.

BACKGROUND

A previously known evaporative fuel processing system recovers evaporative fuel of a fuel tank and introduces the recovered evaporative fuel into an air intake system of an internal combustion engine. The evaporative fuel processing system includes a canister, a purge conduit and a purge valve. The canister recovers the evaporative fuel of the fuel tank. The purge conduit can communicate between an inside of the canister and an inside of the air intake system. The purge valve communicates or discommunicates between the inside of the canister and the inside of the air intake system. For example, JPH11-173220A (corresponding to U.S. Pat. No. 6,138,644A) discloses an evaporative fuel processing system that includes a purge pump, which pumps evaporative fuel recovered by a canister when an air intake system is pressurized by, for example, a supercharger. Furthermore, JP3589632B2 (corresponding to U.S. Pat. No. 6,196,202B1) discloses an evaporative fuel processing system that includes a purge pump, which is driven based on a differential pressure between an inside of an air intake system and an inside of a purge conduit at the time of introducing evaporative fuel recovered by a canister into the air intake system.

However, in the evaporative fuel processing system of JPH11-173220A (corresponding to U.S. Pat. No. 6,138,644A), the purge pump is driven only when the evaporative fuel recovered by the canister is pumped to the inside of the air intake system. Therefore, the purge pump is started from a stop state simultaneously with the time of opening the purge valve. Thus, a delay occurs at the time of introducing the evaporative fuel into the air intake system, and thereby there is a possibility of that the desirable amount of evaporative fuel cannot be introduced into the air intake system.

Furthermore, in the evaporative fuel processing system of JP3589632B2 (corresponding to U.S. Pat. No. 6,196,202B1), the purge pump is driven when the differential pressure between the inside of the air intake system and the inside of the canister is smaller than a predetermined threshold value at the time of opening the purge valve. Therefore, the purge pump is started from a stop state simultaneously with the time of opening the purge valve. Thus, a delay occurs at the time of introducing the evaporative fuel into the air intake system, and thereby there is a possibility of that the desirable amount of evaporative fuel cannot be introduced into the air intake system. Furthermore, in the evaporative fuel processing system of JP3589632B2 (corresponding to U.S. Pat. No. 6,196,202B1), when the differential pressure between the inside of the air intake system and the inside of the canister is larger than the predetermined threshold value at the time of opening the purge valve, the purge pump is not driven. However, when the purge pump is stopped, the stopped purge pump becomes a flow resistance to the evaporative fuel conducted through the purge conduit. Thus, there is a possibility of that the desirable amount of evaporative fuel cannot be introduced into the air intake system.

SUMMARY

The present disclosure addresses the above disadvantages.

According to the present disclosure, there is provided an evaporative fuel processing system that guides evaporative fuel generated in an inside of a fuel tank, which stores fuel of an internal combustion engine, to an air intake system of the internal combustion engine. The evaporative fuel processing system includes a canister, a purge conduit, a purge valve, a purge valve control device, a purge pump, a pump electric power supply device and a pressure sensing device. The canister is communicated with the inside of the fuel tank and recovers the evaporative fuel of the fuel tank. The purge conduit forms a purge passage, which communicates between an inside of the canister and an air intake passage of the air intake system. The purge valve is installed in the purge conduit to communicate or discommunicate between the inside of the canister and the air intake passage. The purge valve control device controls the purge valve to open or close the purge valve. The purge pump is installed in one of: an atmosphere communication conduit, which forms an atmosphere communication passage that communicates between the inside of the canister and atmosphere; and the purge conduit. The purge pump pumps the evaporative fuel, which is recovered by the canister, to the air intake system. The pump electric power supply device supplies an electric power to the purge pump. The pressure sensing device senses a pressure of the air intake passage and outputs a signal, which corresponds to the pressure of the air intake passage. The pump electric power supply device supplies the electric power to the purge pump to form a flow of gas from the inside of the canister to the air intake passage during a running period of the internal combustion engine. The pump electric power supply device changes an amount of the electric power supplied to the purge pump based on the signal outputted from the pressure sensing device at a time of opening the purge valve during the running period of the internal combustion engine.

BRIEF DESCRIPTION OF THE DRAWINGS

The drawings described herein are for illustration purposes only and are not intended to limit the scope of the present disclosure in any way.

DETAILED DESCRIPTION

Various embodiments of the present disclosure will be described with reference to the accompanying drawings.

First Embodiment

Figure 1:
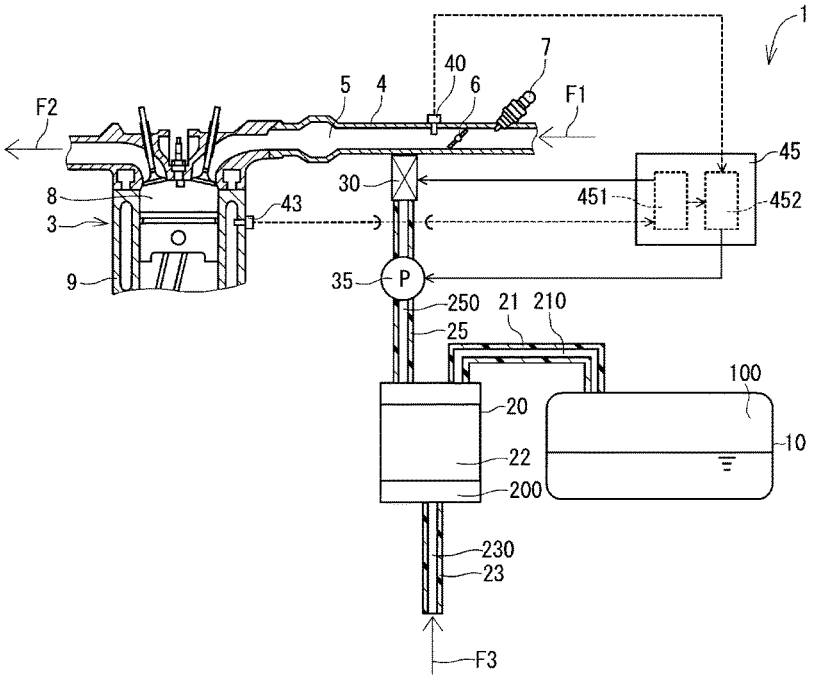
FIG. 1 is a schematic view showing an evaporative fuel processing system according to a first embodiment of the present disclosure.

FIG. 1 shows an evaporative fuel processing system according to a first embodiment of the present disclosure.

The evaporative fuel processing system 1 guides fuel vapor (serving as evaporative fuel), which is generated in an inside (also referred to as a tank inside) 100 of a fuel tank 10 and is recovered by a canister 20, to an air intake conduit 4 through a purge conduit 25. The air intake conduit 4 forms an air intake system and is connected to an internal combustion engine (hereinafter referred to as an engine) 3. The evaporative fuel processing system 1 includes the canister 20, the purge conduit 25, a purge valve 30, a purge pump 35, a pressure sensor (serving as a pressure sensing device or a pressure sensing means) 40, a coolant temperature sensor (serving as a coolant temperature sensing device or a coolant temperature sensing means) 43, and a control apparatus 45. In FIG. 1, a flow of intake air at the engine 3 is indicated by an arrow F1, and a flow of exhaust gas at the engine 3 is indicated by an arrow F2. Furthermore, a flow of an atmospheric gas, which is guided into the evaporative fuel processing system 1, is indicated by an arrow F3.

The canister 20 is connected to the fuel tank 10, which stores fuel to be supplied to the engine 3, through a communication conduit 21. A communication passage 210, which is formed by the communication conduit 21, communicates between the inside 100 of the fuel tank 10 and an inside (also referred to as a canister inside) 200 of the canister 20. An adsorbent material (also referred to as a canister adsorbent material) 22, which can adsorb and desorb the fuel vapor, is received in the inside 200 of the canister 20. The fuel vapor, which is generated in the inside 100 of the fuel tank 10, flows into the inside 200 of the canister 20 through the communication passage 210 and is adsorbed by the adsorbent material 22.

The purge conduit 25 and an atmosphere communication conduit (also referred to as an atmosphere conduit) 23 are installed to the canister 20. The purge conduit 25 includes a purge passage 250, which can communicate between the inside 200 of the canister 20 and an air intake passage 5 of the air intake conduit 4. A purge valve 30 and a purge pump 35 are installed in the purge conduit 25. The atmosphere communication conduit 23 is installed to the canister 20 at a corresponding location of the canister 20, which is different from a location where the communication conduit 21 and the purge conduit 25 are connected to the canister 20. The atmosphere communication conduit 23 includes an atmosphere communication passage (also referred to as an atmosphere passage) 230 that communicates between the atmosphere and the inside 200 of the canister 20.

The purge valve 30 is electrically connected to the control apparatus 45. The purge valve 30 communicates or discommunicates between the inside 200 of the canister 20 and the air intake passage 5 in response to a command signal outputted from the control apparatus 45.

The purge pump 35 is installed in a portion of the purge conduit 25 located between the purge valve 30 and the canister 20. The purge pump 35 is electrically connected to the control apparatus 45. An electric power is supplied from the control apparatus 45 to the purge pump 35 to drive the purge pump 35. The purge pump 35 is driven to form a flow of gas from the inside 200 of the canister 20 to the air intake passage 5 in accordance with the amount of electric power supplied from the control apparatus 45 to the purge pump 35. The operation of the purge pump 35 will be described later.

The pressure sensor 40 is installed into the air intake conduit 4. The pressure sensor 40 senses a pressure of the air intake passage 5 at a location, which is on a downstream side a fuel injection valve 7, which injects fuel into the air intake passage 5, and on a downstream side of a throttle valve 6, which adjusts a quantity of intake air that flows in the air intake passage 5. The measured pressure of the air intake passage 5 is outputted from the pressure sensor 40 to the control apparatus 45.

The coolant temperature sensor 43 is installed to a cylinder block 9, which forms a combustion chamber 8 of the engine 3. The coolant temperature sensor 43 senses a temperature of coolant fluid (cooling water), which flows in an inside of the cylinder block 9. The measured temperature of the coolant fluid is outputted from the coolant temperature sensor 43 to the control apparatus 45.

The control apparatus 45 is formed by a microcomputer that has a CPU, a RAM and a ROM. The CPU serves as a computing means, and the RAM and the ROM serve as a storage means. The control apparatus 45 includes a purge valve control device 451 and a pump electric power supply device 452.

The purge valve control device 451 control the purge valve 30 to open or close the purge valve 30 according to the output signal of the coolant temperature sensor 43.

The pump electric power supply device 452 changes the amount of electric power (more specifically, the amount of electric current), which is supplied to the purge pump 35, based on the output signal of the pressure sensor 40 and an opening/closing state of the purge valve 30.

Next, the operation of the evaporative fuel processing system 1 of the first embodiment will be described.

In a stop state of the engine 3 where the engine 3 is stopped, the purge valve control device 451 maintains a valve closed state of the purge valve 30 (i.e., a closed state of the purge valve 30, in which the purge valve 30 is closed). At this time, the pump electric power supply device 452 stops the supply of the electric power to the purge pump 35.

During a running period of the engine 3, in which the engine 3 is running, the pump electric power supply device 452 supplies the electric power to the purge pump 35 based on the output signal of the coolant temperature sensor 43. Specifically, when the temperature of the coolant fluid, which is sensed with the coolant temperature sensor 43, is equal to or higher than a predetermined temperature, the pump electric power supply device 452 supplies the corresponding electric power to the purge pump 35 to drive the purge pump 35 at a relatively low speed that does not cause generation of a flow resistance by the purge pump 35 relative to the gas that flows from the inside 200 of the canister 20 toward the air intake passage 5 in the purge passage 250. Here, for example, the predetermined temperature referrers to a temperature of the coolant fluid, at which the running state (operational state) of the engine 3 is in a steady running state (steady operational state) after elapse of a predetermined time period from a time of starting the engine 3.

At the time of opening the purge valve 30 in response to the command signal outputted from the purge valve control device 451, the pump electric power supply device 452 changes the amount of electric current (hereinafter referred to as "pump electric current") supplied to the purge pump 35 according to a pressure difference between the pressure of the inside 200 of the canister 20 and the pressure of the air intake passage 5. Now, a relationship among the amount of the pump electric current, which is conducted through the purge pump 35 at the time of opening the purge valve 30, a purge quantity of the gas introduced into the air intake conduit 4 by the evaporative fuel processing system 1, and the pressure of the air intake passage 5 will be described with reference to FIG. 2.

Figure 2:
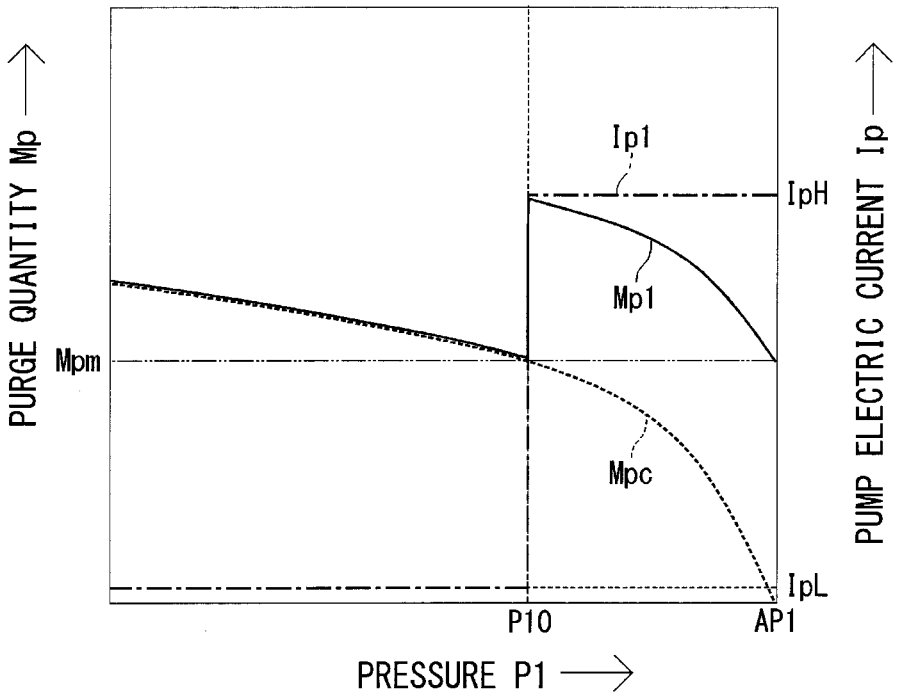
FIG. 2 is a characteristic diagram for describing an operation of the evaporative fuel processing system of the first embodiment.

FIG. 2 is a characteristic diagram showing the relationship among the pump electric current Ip conducted through the purge pump 35, the purge quantity Mp of the gas introduced into the air intake conduit 4 by the evaporative fuel processing system 1, and the pressure P1 of the air intake passage 5. In FIG. 2, an axis of abscissas indicates the pressure P1. An atmospheric pressure is indicated as a pressure AP1 along the axis of abscissas in FIG. 2. That is, the pressure P1 indicated along the axis of abscissas is in a range that is lower than the atmospheric pressure. Furthermore, in FIG. 2, a first axis of ordinates indicates the purge quantity Mp, and a second axis of ordinates indicates the pump electric current Ip. In the evaporative fuel processing system 1 of the first embodiment, a purge quantity (serving as a predetermined purge quantity) Mpm is set. The purge quantity Mpm is a lower limit value of the purge quantity of the gas introduced into the air intake conduit 4 by the evaporative fuel processing system 1. In FIG. 2, a relationship between the pressure P1 of the air intake passage 5 and the purge quantity Mp at the evaporative fuel processing system 1 of the first embodiment is indicated by a solid line Mp1, and a relationship between the pressure P1 of the air intake passage 5 and the pump electric current Ip at the evaporative fuel processing system 1 of the first embodiment is indicated by a dot-dash line Ip1. Furthermore, as a comparative example, a relationship between a pressure P1 of an air intake passage and a purge quantity Mp at a comparative evaporative fuel processing system, which does not have the purge pump, is indicated by a dotted line Mpc.

First of all, the relationship between the pressure P1 of the air intake passage and the purge quantity Mp at the comparative evaporative fuel processing system, which does not have the purge pump, will be described.

In the comparative evaporative fuel processing system, which does not have the purge pump, when the pressure P1 is equal to or smaller than a predetermined pressure P10, the quantity of the evaporative fuel, which is introduced into the air intake conduit, is larger than the purge quantity Mpm, which is the lower limit value of the purge quantity, as indicated by the dotted line Mpc. In contrast, when the pressure P1 is larger than the predetermined pressure P10, the quantity of the evaporative fuel, which is introduced into the air intake conduit, is smaller than the purge quantity Mpm, which is the lower limit value of the purge quantity, as indicated by the dotted line Mpc, due to the fact of that a differential pressure between the pressure of the air intake passage 5 and the pressure of the inside of the canister 20 is small.

In the evaporative fuel processing system 1 of the first embodiment, when the pressure P1 is equal to or smaller than the predetermined pressure P10, the quantity (purge quantity Mp) of the evaporative fuel, which is introduced into the air intake conduit 4, is larger than the purge quantity Mpm, which is the lower limit value of the purge quantity, as indicated by the solid line Mp1 in FIG. 2. When the pressure P1 is equal to or smaller than the predetermined pressure P10, the amount of the pump electric current Ip becomes a relatively small amount IpL, which enables running of the purge pump 35 at a relatively low speed, as indicated by the dot-dash line Ip1 in FIG. 2. In this way, the purge pump 35 is kept running synchronously with the flow of the gas in the purge passage 250 without causing generation of the flow resistance by the purge pump 35 relative to the gas conducted through the purge passage 250 like the operation of the purge pump 35 in the valve closed state of the purge valve 30 during the running period of the engine 3. In other words, the pump electric power supply device 452 supplies the relatively small amount of the electric power to the purge pump 35 to run the purge pump 35 synchronously with the flow of the gas in the purge passage 250.

When the pressure P1 is larger than the predetermined pressure P10, the pump electric power supply device 452 supplies the electric power to the purge pump 35 such that the pump electric current IpH, which is larger than the pump electric current IpL, is conducted through the purge pump 35, as indicated by the solid line Mp1 in FIG. 2. In this way, the purge pump 35 is running at a relatively high speed, so that the evaporative fuel in the inside 200 of the canister 20 is pumped to the air intake passage 5. Therefore, in the pressure range, in which the pressure P1 is larger than the predetermined pressure P10, the evaporative fuel processing system 1 can introduce a corresponding quantity of the evaporative fuel, which is larger than the purge quantity indicated by the dotted line Mpc and is larger than the lower limit value Mpm of the purge quantity, to the air intake conduit 4. In other words, the pump electric power supply device 452 supplies the relatively large amount of the electric power to the purge pump 35 to increase the quantity of the evaporative fuel, which is supplied from the canister 20 to the air intake passage 5, beyond the lower limit value (the predetermined purge quantity) MPm.

In the previously proposed evaporative fuel processing system that has the purge pump, which pumps the evaporative fuel recovered by the canister toward the air intake passage, the purge pump is stopped when the purge valve is closed. Furthermore, in this previously proposed evaporative fuel processing system, the purge pump begins to run simultaneously with the time of starting an opening operation of the purge valve. Therefore, a required time period, which is required to run the purge pump at a sufficiently high speed for introducing the desirable quantity of the evaporative fuel to the air intake conduit, is disadvantageously lengthened. Thus, the timing, at which introduction of the desirable quantity of the evaporative fuel to the air intake conduit is enabled, is delayed from the timing of opening the purge valve.

In the evaporative fuel processing system 1 of the first embodiment, the pump electric power supply device 452 supplies the corresponding amount of electric power to the purge pump 35 to run the purge pump 35 at the relatively low speed in the valve closed state of the purge valve 30 during the running period of the engine 3. In this way, at the time of introducing the evaporative fuel from the inside 200 of the canister 20 to the air intake conduit 4 by opening the purge valve 30, the required time period can be reduced in comparison to the case where the purge pump is driven from the stop state to the corresponding operational state, at which the desirable quantity of the evaporative fuel can be introduced into the air intake conduit. Thus, the relatively large quantity of the evaporative fuel can be introduced into the air intake conduit 4 simultaneously with the time of opening the purge valve 30. Thereby, a delay in the introduction of the evaporative fuel into the air intake conduit 4 relative to the opening/closing operation of the purge valve 30 can be reduced or minimized, so that it is possible to achieve the improved supply response of the evaporative fuel.

Furthermore, when the pressure P1 of the air intake passage 5 is equal to or smaller than the predetermined pressure P10, the evaporative fuel in the inside 200 of the canister 20 is introduced into the air intake conduit 4 by the differential pressure between the pressure of the inside 200 of the canister 20 and the pressure of the air intake passage 5. At this time, the pump electric power supply device 452 supplies the electric power to the purge pump 35 such that the pump electric current IpL is conducted through the purge pump 35 to drive the purge pump 35 at the relatively low speed that does not cause generation of the flow resistance by the purge pump 35 relative to the gas that flows in the purge passage 250. The pump electric current IpL is smaller than the pump electric current IpH, which is conducted through the purge pump 35 at the time of pumping the evaporative fuel from the inside 200 of the canister 20 to the air intake passage 5. As discussed above, in the evaporative fuel processing system 1, the pump electric current Ip is changed in a stepwise manner in response to the pressure of the air intake passage 5, and the pump electric current (the amount of the pump electric current) Ip is made small when the pumping of the evaporative fuel by the purge pump 35 is not required. In this way, the electric power consumed by the purge pump 35 can be reduced.

Furthermore, in the evaporative fuel processing system having the previously proposed purge pump, when the purge pump is stopped, the stopped purge pump becomes the flow resistance to the gas that flows in the purge passage 250. Thus, in such a case, a bypass passage, which bypasses the purge pump, needs to be provided in the evaporative fuel processing system. In contrast, in the evaporative fuel processing system 1 of the first embodiment, when the evaporative fuel can be introduced from the inside 200 of the canister 20 to the air intake conduit 4 only by the differential pressure between the pressure of the inside 200 of the canister 20 and the pressure of the air intake passage 5, the purge pump 35 is driven at the relatively low speed that does not cause generation of the flow resistance by the purge pump 35 relative to the gas that flows in the purge passage 250. In this way, the bypass passage, which bypasses the purge pump, is not required. Thus, the manufacturing costs of the evaporative fuel processing system 1 can be reduced.

Furthermore, in the evaporative fuel processing system 1, the purge valve 30 is controlled to open or close the purge valve 30 based on the signal, which is outputted from the coolant temperature sensor 43 that senses the temperature of the coolant fluid of the engine 3. In this way, it is possible to limit the introduction of the evaporative fuel into the air intake conduit 4 during the transition time period that is from the time of starting the running of the engine 3 to the time of reaching the steady running state (steady operational state) of the engine 3, in which the temperature of the coolant fluid is stabilized.

Second Embodiment

Next, an evaporative fuel processing system according to a second embodiment of the present disclosure will be described with reference to FIGS. 3 and 4. In the second embodiment, the location of the purge pump and the amount of the pump electric current conducted through the purge pump at the time of opening the purge valve are different from those of the first embodiment. In the second embodiment, the portions and the components, which are the same as those of the first embodiment, will be indicated by the same reference numerals and will not be discussed further for the sake of simplicity.

Figure 3:
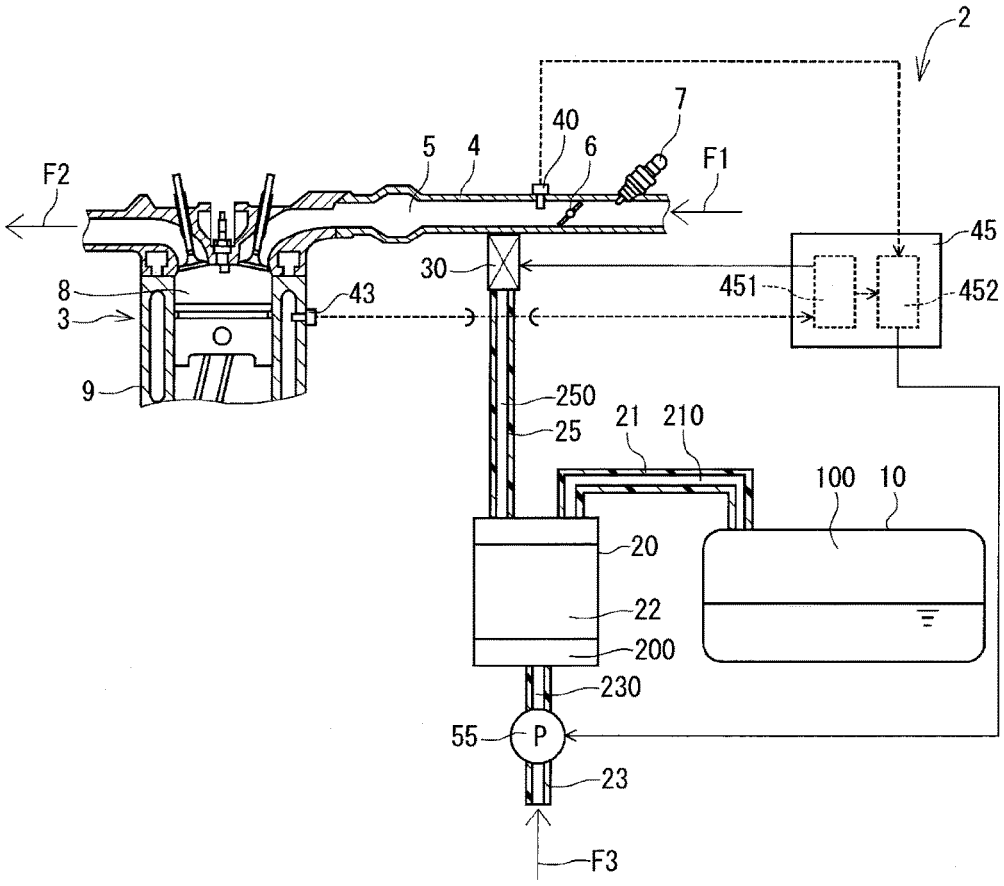
FIG. 3 is a schematic view showing an evaporative fuel processing system according to a second embodiment of the present disclosure.

In the evaporative fuel processing system 2 of the second embodiment, as shown in FIG. 3, the purge pump 55 is installed in the atmosphere communication conduit 23. The purge pump 55 is electrically connected to the pump electric power supply device 452. The purge pump 55 is operated to generate a flow of the gas from the inside 200 of the canister 20 to the air intake passage 5 in response to the amount of the electric power supplied from the pump electric power supply device 452 to the purge pump 55.

Figure 4:
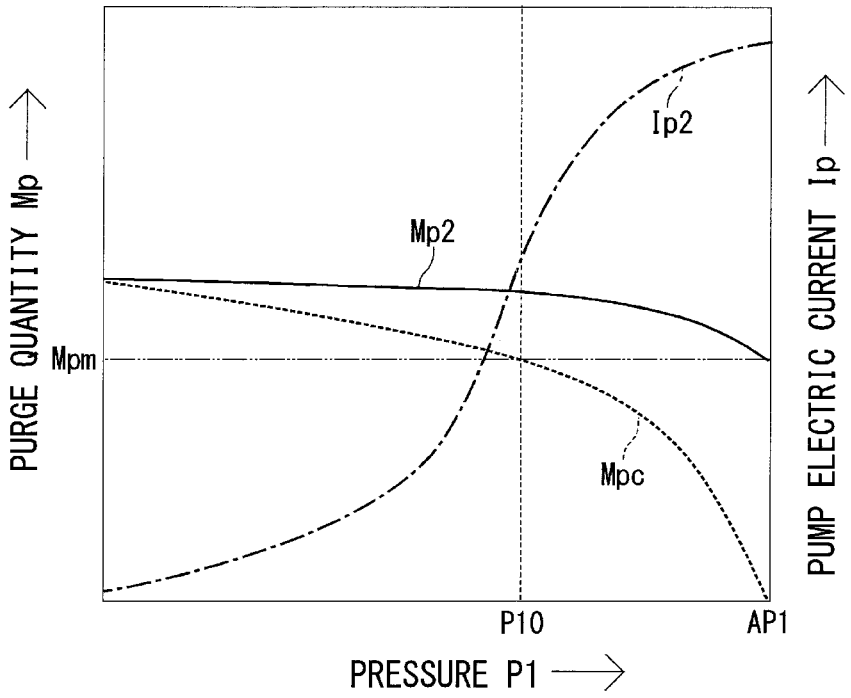
FIG. 4 is a characteristic diagram for describing an operation of the evaporative fuel processing system of the second embodiment.

In the evaporative fuel processing system 2, when the purge valve 30 is opened, the pump electric current Ip is continuously changed based on a value of the pressure P1 of the air intake passage 5, as indicated in FIG. 4.

FIG. 4 is a characteristic diagram showing the relationship among the pump electric current Ip conducted through the purge pump 35, the purge quantity Mp of the gas introduced into the air intake conduit 4 by the evaporative fuel processing system 1, and the pressure P1 of the air intake passage 5. In FIG. 4, a relationship between the pressure P1 of the air intake passage 5 and the purge quantity Mp at the evaporative fuel processing system 2 of the second embodiment is indicated by a solid line Mp2, and a relationship between the pressure P1 of the air intake passage 5 and the pump electric current Ip at the evaporative fuel processing system 2 of the second embodiment is indicated by a dot-dash line Ip2.

As indicated in FIG. 4, in the evaporative fuel processing system 2, in the pressure range, in which the pressure P1 is larger than the predetermined pressure P10, the pump electric power supply device 452 supplies the corresponding electric power to the purge pump 55 such that the relatively large amount of electric current Ip is conducted through the purge pump 55. In this way, the evaporative fuel, which is recovered by the canister 20, is pumped by the purge pump 55 toward the air intake passage 5. Therefore, the quantity of the evaporative fuel, which is introduced into the air intake passage 5 in the pressure range where the pressure P1 is larger than the predetermined pressure P10, becomes larger than the purge quantity indicated by the dotted line Mpc (indicating the relationship between the pressure P1 of the air intake passage and the purge quantity Mp at the comparative evaporative fuel processing system having no purge pump) and is larger than the purge quantity Mpm, which is the lower limit value of the purge quantity. At this time, the pump electric power supply device 452 continuously changes the electric power supplied to the purge pump 55 in such a manner that the pump electric current Ip is increased when the pressure P1 approaches the atmospheric pressure.

Furthermore, in a pressure range, in which the pressure P1 is equal to or smaller than the predetermined pressure P10, the pump electric power supply device 452 supplies the electric power to the purge pump 55 in such a manner that the relatively small pump electric current Ip is conducted through the purge pump 55. In this way, the purge pump 55 is operated such that the purge pump 55 does not become the flow resistance to the gas that flows in the purge passage 250. At this time, the pump electric power supply device 452 continuously changes the electric power supplied to the purge pump 55 in such a manner that the pump electric current Ip is reduced when the pressure P1 is reduced.

In the evaporative fuel processing system 2 of the second embodiment, the electric power supplied to the purge pump 55 is changed such that the amount of the pump electric current Ip, which is conducted through the purge pump 55, is continuously changed at the time of opening the purge valve 30 during the running period of the engine 3. In the state where the desirable quantity of the evaporative fuel cannot be introduced into the air intake passage 5 only by the differential pressure between the pressure of the inside 200 of the canister 20 and the pressure of the air intake passage 5, the pump electric power supply device 452 supplies the relatively large amount of electric power to the purge pump 55 to enable pumping of the evaporative fuel from the inside 200 of the canister 20 by the purge pump 55 to the air intake passage 5. Furthermore, in the state where the desirable quantity of the evaporative fuel can be introduced into the air intake passage 5 only by the differential pressure between the pressure of the inside 200 of the canister 20 and the pressure of the air intake passage 5, the pump electric power supply device 452 supplies the relatively small amount of electric power, which does not cause generation of the flow resistance by the purge pump 55 relative to the gas that flows in the purge passage 250, to the purge pump 55. In this way, the second embodiment can provide the advantages, which are similar to those of the first embodiment.

Furthermore, in the evaporative fuel processing system 2 of the second embodiment, the purge pump 55 is installed in the atmosphere communication conduit 23 that forms the atmosphere communication passage 230. In this way, the evaporative fuel does not pass through the inside of the purge pump 55, so that a required degree of fuel resistance and a required degree of explosion-proof of the purge pump 55 can be set to lower values. Thus, the manufacturing costs of the evaporative fuel processing system 2 can be further reduced.

Now, modifications of the above embodiments will be described.

(A) In the above embodiments, the purge pump is controlled by the amount of the electric current conducted through the purge pump. However, the control method of the purge pump is not limited to this method. For example, the purge pump may be controlled by the amount of voltage applied to the purge pump.

(B) In the above embodiments, when the temperature of the coolant fluid, which is sensed with the coolant temperature sensor, is equal to or higher than the predetermined temperature (i.e., the temperature of the coolant fluid, at which the running state of the engine is in the steady running state after elapse of the predetermined time period from the time of starting the engine), the purge pump is driven. However, the condition for driving the purge pump is not limited to this condition. For example, the purge pump may begin to be driven from the time point, at which the purge valve can be opened.

(C) In the first embodiment, the pump electric current, which is conducted through the purge pump, is controlled in the two steps. However, the number of steps for controlling the amount of the pump electric current is not limited to the two steps. The number of steps for controlling the amount of the pump electric current may be increased to three or more, if desired.

The present disclosure is not limited to the above embodiments, and the above embodiments may be modified within the spirit and scope of the present disclosure.

What is claimed is:

1. An evaporative fuel processing system that guides evaporative fuel generated in an inside of a fuel tank, which stores fuel of an internal combustion engine, to an air intake system of the internal combustion engine, the evaporative fuel processing system comprising:

a canister that is communicated with the inside of the fuel tank and recovers the evaporative fuel of the fuel tank;

a purge conduit that forms a purge passage, which communicates between an inside of the canister and an air intake passage of the air intake system;

a purge valve that is installed in the purge conduit to communicate or discommunicate between the inside of the canister and the air intake passage;

a purge valve control device that controls the purge valve to open or close the purge valve;

a purge pump that is installed in one of:

an atmosphere communication conduit, which forms an atmosphere communication passage that communicates between the inside of the canister and atmosphere; and the purge conduit, wherein the purge pump pumps the evaporative fuel, which is recovered by the canister, to the air intake system;

a pump electric power supply device that supplies an electric power to the purge pump; and a pressure sensing device that senses a pressure of the air intake passage and outputs a signal, which corresponds to the pressure of the air intake passage, wherein:

the pump electric power supply device supplies the electric power to the purge pump to form a flow of gas from the inside of the canister to the air intake passage during a running period of the internal combustion engine; and the pump electric power supply device changes an amount of the electric power supplied to the purge pump based on the signal outputted from the pressure sensing device at a time of opening the purge valve during the running period of the internal combustion engine.

2. The evaporative fuel processing system according to claim 1, wherein the purge pump is installed in the atmosphere communication conduit.

3. The evaporative fuel processing system according to claim 1, wherein:

when the pressure of the air intake passage is larger than a predetermined pressure, the pump electric power supply device supplies a relatively large amount of the electric power to the purge pump to increase a quantity of the evaporative fuel, which is supplied from the canister to the air intake passage, beyond a predetermined purge quantity; and when the pressure of the air intake passage is smaller than the predetermined pressure, the pump electric power supply device supplies a relatively small amount of the electric power to the purge pump to run the purge pump synchronously with a flow of the gas in the purge passage.

4. The evaporative fuel processing system according to claim 1, comprising a coolant temperature sensing device that senses a temperature of a coolant fluid of the internal combustion engine and outputs a signal, which corresponds to the temperature of the coolant fluid, to the purge valve control device, wherein:

the purge valve control device controls the purge valve to open or close the purge valve based on the signal outputted from the coolant temperature sensing device.

* * * * *